US005551653A

United States Patent [19]

Friebe et al.

[11] Patent Number: 5,551,653

[45] Date of Patent: Sep. 3, 1996

[54] METHOD AND DEVICE FOR THE RADIO-FREQUENCY CONNECTION OF ACTIVE SUBSECTIONS OF A RADIO-FREQUENCY TRANSMISSION SYSTEM

[75] Inventors: Eberhard Friebe; Matthias Moritz; Sepp Schoenbacher, all of Berlin, Germany

[73] Assignee: Robert Bosch GmbH, Stuttgart, Germany

[21] Appl. No.: 284,530

[22] PCT Filed: Mar. 26, 1993

[86] PCT No.: PCT/DE93/00285

§ 371 Date: Aug. 4, 1994

§ 102(e) Date: Aug. 4, 1994

[87] PCT Pub. No.: WO93/19966

PCT Pub. Date: Oct. 14, 1993

[30] Foreign Application Priority Data

Apr. 2, 1992 [DE] Germany ..... 42 11 377.6

[51] Int. Cl.[6] ..... B61L 23/00

[52] U.S. Cl. ..... 246/167 R; 246/8; 246/219

[58] Field of Search ..... 246/7, 8, 167 R, 246/218, 219; 213/1.3; 340/438, 531

[56] References Cited

U.S. PATENT DOCUMENTS

| | | | |
|---|---|---|---|
| 3,696,758 | 10/1972 | Godinez, Jr. | 246/167 R |
| 4,041,470 | 8/1977 | Slane et al. | 246/169 R |
| 4,257,032 | 5/1981 | Schneider | 246/167 R |
| 4,582,280 | 4/1986 | Nichols et al. | 246/167 R |
| 4,835,494 | 5/1989 | Preschutti . | |

FOREIGN PATENT DOCUMENTS

| | | |
|---|---|---|
| 423028 | 4/1991 | European Pat. Off. . |
| 2302641 | 9/1976 | France . |

*Primary Examiner*—Robert J. Oberleitner
*Assistant Examiner*—S. Joseph Morano
*Attorney, Agent, or Firm*—Michael J. Striker

[57] ABSTRACT

If a vehicle fitted with a head station is to be mechanically and electrically coupled to other vehicles, attention must be paid to the alignment of the vehicles and the coupling condition of the high frequency plugs interconnecting the vehicles. In order to reduce the labor and time required in the high frequency coupling of the vehicles, each vehicle, except for the one with the head station, is fitted with a vehicle station which is connected to the ends of the vehicles via paired high frequency lines by plug-in components. Before the high frequency signals are switched through in a vehicle, the vehicle station checks whether there is a high frequency signal and whether or not the plugs are coupled.

7 Claims, 5 Drawing Sheets

Fig.3

Figures 1, 2:
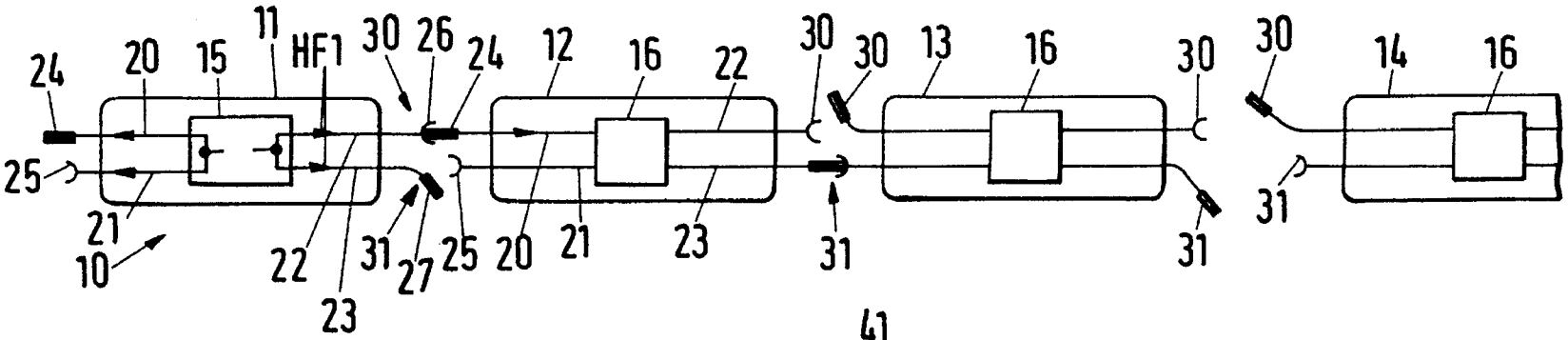

| | 40 Fig.2 | | HF- D1 (HF1) | D2 (HF2) | |
|---|---|---|---|---|---|
| a | 3 - 5 | | n | x | 1. |
| b | 4 - 5 | | n | x | |
| c | 2 - 5 | | n | x | |
| d | 1 - 5 | | j | x | |
| e | 1 - 5 | 6 - 3 | j | j | 2. |
| f | 1 - 5 | 6 - 4 | j | n | |

43 j =
n =
x =

Fig.5

| | | 13 | | | 12 | | 12 | 13 |
|---|---|---|---|---|---|---|---|---|
| | | 40(Fig.4) | | | 40(Fig.4) | D2 HF2 | D1 HF1 | D1 HF1 |
| 1. | a | 5 - 3 | | e | 3 - 6 | n | j | n |
| | b | 5 - 4 | | e | 3 - 6 | n | j | n |
| | c | 5 - 2 | | e | 3 - 6 | n | j | n |
| | d | 5 - 1 | | e | 3 6 | n | j | n |
| 1. | a | 5 - 3 | 2. | f | 4 - 6 | n | j | n |
| | b | 5 - 4 | | f | 4 - 6 | n | j | n |
| | c | 5 - 2 | | f | 4 - 6 | j | j | j |

43

METHOD AND DEVICE FOR THE RADIO-FREQUENCY CONNECTION OF ACTIVE SUBSECTIONS OF A RADIO-FREQUENCY TRANSMISSION SYSTEM

A method and a device for carrying out this method are known according to which a head station is provided in one of a plurality of excursion train carriages forming a railway train. At least one radio-frequency cable is passed through each carriage, into which an amplifier is looped in order to amplify the radio-frequency signals which are to be transmitted, in one direction. The directionally correct, manual through-connection of the radio-frequency cables, which can be connected via plug connectors, is dependent on qualified personnel and takes a relatively long time.

The invention is based on a device for carrying out the method in such a manner that the radio-frequency, directionally correct through-connection of the transmission path in a vehicle unit which consists of vehicles which are assembled in any desired sequence and in any desired vehicle direction, is carried out with as little expenditure as possible in terms of personnel and time.

This is linked to the advantage that irrespective of whether the vehicles are used in a first orientation or in a second orientation rotated through 180° with respect thereto, the radio-frequency through-connection of the transmission path in the vehicles is carried out automatically, after a previous test.

As a result a device for carrying out the method is implemented using means which are particularly simple and operate in an operationally reliable manner.

A preferred application for the method according to the invention and the device for carrying out this method is in excursion trains.

Figure 4:
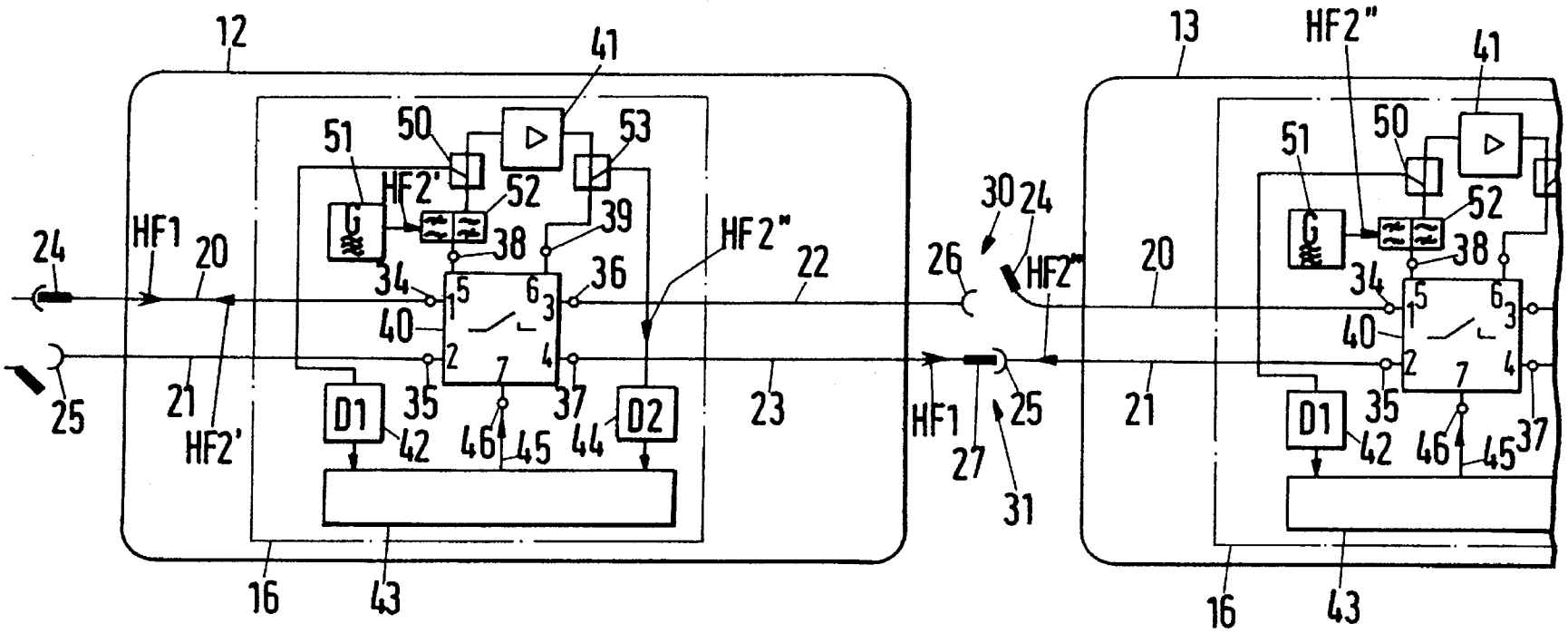
Figure 6:
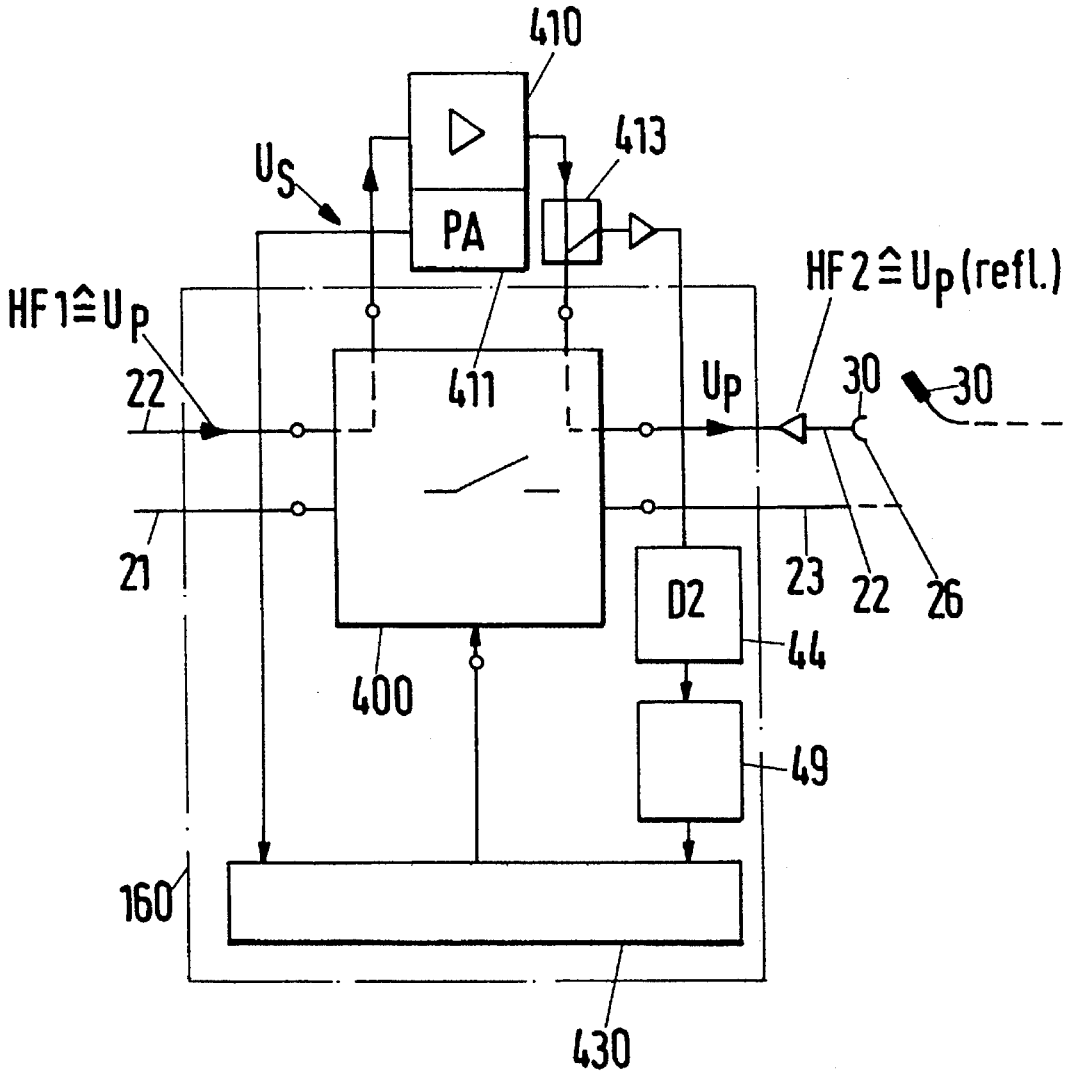

Exemplary embodiments of the invention are explained in more detail in the following text and are shown in the drawing, using a plurality of figures, in which:

FIG. 1 shows a block diagram of a transmission system for a vehicle unit comprising a plurality of vehicles, FIG. 2 shows a block diagram of a vehicle station according to the invention for a vehicle, in a first configuration, FIG. 3 shows a scheme for explaining the operation of the vehicle station according to FIG. 2, FIG. 4 shows a block diagram of a vehicle station for a vehicle, in a second configuration, FIG. 5 shows a scheme for explaining the vehicle station according to FIG. 4, and FIG. 6 shows a block diagram of a vehicle station for a vehicle, in a third configuration.

In FIG. 1, 10 designates a vehicle unit which comprises a plurality of mechanically coupled vehicles 11, 12, 13 and 14. The first vehicle 11 is equipped with a head station 15, and the other vehicles 12, 13 and 14 in each case contain one vehicle station 16. The head station 15 and the vehicle stations 16 are connected to one another via in each case two parallel-connected radio-frequency cables 20, 21; 22, 23, which have plug connector elements 24, 25; 26, 27 at the ends of in each case one vehicle. In each case two parallel-connected radio-frequency cables are provided, for reasons of operating reliability (UIC Standard 568), and in each case two associated plug connector elements 24, 25; 26, 27 form a radio-frequency plug connector 30 and 31. In the exemplary embodiment according to FIG. 1, the radio-frequency plug connector 30 is coupled between the vehicles 11 and 12 in the same way as the radio-frequency plug connector 31 between the vehicles 12 and 13; in contrast, all the other radio-frequency plug connectors are not coupled.

FIG. 2 shows the construction of a vehicle station 16 in one of the vehicles 12 to 14, namely in the vehicle 12. Inside the vehicle, the radio-frequency cables 20, 21 and 22, 23 are connected to a first to fourth connection 34 to 37 (1 . . . 4) of a switching device 40 which belongs to the vehicle station 16. A fifth connection 38 (5) is connected firstly to one input of a radio-frequency amplifier 41 and secondly, via a first detector circuit 42 (D1), to a time-sequence controller 43. A sixth connection 39 (6) of the switching device 40 is connected firstly, via a radio-frequency coupler 48 which is preferably a direction coupler, to the output of the radio-frequency amplifier 41. Secondly, this connection is connected via the branch of the radio-frequency coupler 48 and a second detector circuit 44, to which a radio-frequency generator 47 for generating a radio-frequency signal HFM belongs, via an invertor 49, to the time-sequence controller 43, whose output 45 is connected to a seventh connection 46 (7) of the switching device 40. The seventh connection 46 forms the control input for the switching device 40.

The method of operation of the arrangement which is described using FIGS. 1 and 2 is as follows.

If a plurality of vehicles, for example the vehicles 11, 12, 13 in FIG. 1, are mechanically coupled, and the radio-frequency plug connectors 30 between the vehicles 11 and 12 as well as the radio-frequency plug connector 31 between the vehicles 12 and 13 are coupled, and the other radio-frequency plug connectors are decoupled, then the vehicle station 16 of the vehicle 12 initially determines which of the radio-frequency cables 20 21; 22, 23 allocated to it have a first radio-frequency signal HF1, transmitted from a head station, applied to them. For this purpose, the time-sequence controller 43 of the vehicle 12 switches the switching device 40 onwards in time intervals, in such a manner that the third connection 3 and the fifth connection 5 are connected in a first time interval a; to cf. the scheme in FIG. 3, in which the time intervals a to f are shown. In the time interval a, in which only the connections 3 and 5 are connected, the first detector circuit 42 (D1), which emits a first signal to the time-sequence controller 43 only in the event o a radio-frequency signal HF1 which is recognised by it, determines that no first radio-frequency signal is being passed to the vehicle station 16 via the radio-frequency cable 22 of the vehicle 12 (D1=n=no). The time-sequence controller 43 thereupon opens, in the following time interval b, the connection between the connections 3 and 5 and closes the connection between the connections 4 and 5 . The first detector circuit 42 identifies no first radio-frequency signal HF1 ; D1=n in this time interval as well. In the time interval c, the time-sequence controller 43 subsequently opens the connection between the connections 4 and 5, and bridges the connections 2 and 5. The first detector circuit 42 also determines in this time interval that there is no first radio-frequency signal HF1 arriving via the radio-frequency cable 21 of the vehicle 12; D1=n. In a further time interval d, the connection between the connections 2 and 5 is opened and a connection is produced between the connections 1 and 5. In this switching position, the first detector circuit 42 identifies the presence of a first radio-frequency signal HF1 (D1=j=yes) of the head station 15 and thereupon emits a second signal to the time-sequence controller 43. The latter supplies a signal to the switching device 40 which ensures that the connection between the connections 1 and 5 remains in existence. This terminates a first algorithm; cf. FIG. 3. The second detector circuit 44 (D2) is admittedly also connected successively, in the time intervals a to d, via the connection 5 and the radio-frequency amplifier 41 to the radio-frequency cables 20 to 23; however, the second detector circuit 44 has no function in this algorithm.

Connected to the first algorithm, which terminates with the locking of the connection between the connections 1 and 5, is a second algorithm by means of which the coupling state of the radio-frequency plug connectors 30 and 31 between the vehicles 12 and 13 is determined. The second algorithm starts in such a manner that, in a time interval e, the switching device 40 is influenced via the time-sequence controller 43 by the output signal of the first detector circuit 42 (D1) in such a manner that a connection is produced between the connections 6 and 3. In this way, the second radio-frequency signal HFM of the radio-frequency generator 47, which signal differs from the first radio-frequency signal HF1, is passed via the radio-frequency coupler 48, the connections 6 and 3, and the radio-frequency cable 22 to the non-coupled radio-frequency plug connector 30 between the vehicles 12 and 13. The second radio-frequency cy signal HFM is reflected on the plug connector part 26 of the vehicle 12 and is identified by the second detector circuit 44 as a reflected radio-frequency signal HF2; D2=j=yes. Only in the case of a reflection does the second detector circuit emit a specific output signal which, after inversion by the invertor 49 via the time-sequence controller 43, causes the switching device 40 to connect the connections 6 and 4 in a time interval f. In this switching state, the second radio-frequency signal HFM is passed via the radio-frequency coupler 48 and the interconnected connections 6 and 4 and the radio-frequency cable 23 to the coupled radio-frequency connector 31 between the vehicles 12 and 13. At the same time, the second detector circuit 44 determines that the second radio-frequency signal HFM, emitted by the radio-frequency generator 47, is not reflected; D2=n=no. Since, thus, the first detector 42 has identified the first radio-frequency signal HF1, and the second detector 44 has not identified the second radio-frequency signal HF2, the connections between the connections 1 and 5 as well as between 6 and 4 remain in existence, so that the radio-frequency signal HF1 passes via the radio-frequency cable 20 of the vehicle 12, the radio-frequency amplifier 41, the radio-frequency cable 23 and the radio-frequency plug connector 31 between the vehicles 12 and 13, to the radio-frequency cable 21 of the vehicle 13.

If, for example, the radio-frequency plug connector 31 between the vehicles 12 and 13 were also interrupted, then the second detector circuit 44 would also determine a reflection of the second radio-frequency signal HF2 in the time interval f, and would repeat the test process. Alter one or more repetitions, the test process can be discontinued, controlled by the time-sequence controller 43, for a relatively long time interval, and then started again.

For other coupling situations of the radio-frequency plug connectors 30, 31, the time sequence described in conjunction with the scheme in FIG. 3 applies in an analogous manner. The only case which should be regarded as a further example is that in which the vehicle 11 in FIG. 1 is not located in front of the vehicle 12, but behind it that is to say the vehicles 11 and 13 are interchanged. Since the radio-frequency amplifier 41 of the vehicle 12 can amplify first radio-frequency signals HF1 in only one signal direction, the switching device 40 must be programmed such that, for example in a first algorithm, it initially interconnects the connections 3 and 5 and then the connections 4 and 5. Since the first radio-frequency signal HF1 has then already been identified by the first detector circuit 42, after the switching operation in which the connections 4 and 5 are connected the second algorithm can be connected, in which the connections 6 and 2, and 6 and 1 respectively, are connected successively, so that the second detector circuit 44 can determine which radio-frequency plug connection is coupled between the vehicle 12 and the vehicle 13 which is now located in the first position.

In a second configuration, shown in FIG. 4, of a vehicle station which does not operate using the reflectometer principle in the same way as the configuration according to FIGS. 2 and 3, a second radio-frequency signal HF2' and HF2" is produced in each vehicle, for example 12 and 13, by a radio-frequency generator 51. In this case, the radio-frequency generator 47 and the invertor 49 according to FIG. 2 are thus omitted.

The frequency of the second radio-frequency signal HF2 should preferably be located outside the transmission frequency band of the radio-frequency amplifier 41. In the example according to FIG. 4, the frequency of the second radio-frequency signal HF2 is selected to be below the transmission frequency band of the radio-frequency amplifier 41. The second radio-frequency signal HF2' or HF2" is preferably supplied via a radio-frequency filter 52 to the fifth connection 38 of the switching device 40. The switching device 40 in the vehicle 13 successively produces the connections shown in the scheme according to FIG. 5, algorithm 1. At the same time, a connection between the connections 3 and 6 is produced in the vehicle 12. Since the plug connector 30 between the vehicles 12 and 13 is opened, the second detector D2 of the vehicle 12 cannot evaluate the second radio-frequency signal HF2" of the vehicle 13. Thereafter, the connection between the connection 4 and 6 of the vehicle 12 is produced. In the event of the connection of the connections 2 and 5 in the vehicle 13 and the connection of the connection 4 and 6 in the vehicle 12, the detector 44 in the vehicle 12 identifies the second radio-frequency signal HF2" and causes the switching device 40 to maintain the switch position 4-6. At the same time, the first detector 42 in the vehicle 13 identifies the first radio-frequency signal HF1 and causes the switching device 40 in the vehicle 13 to remain in the switch position 2-5.

In a third configuration, a vehicle station 160 according to FIG. 6 has a pilot-regulated amplifier 410 whose gain is regulated as a function of a pilot signal $U_p$ which is also emitted by the head station 15. A pilot evaluation circuit 411, which belongs to the pilot-regulated amplifier, emits a specific control signal $U_s$ when a pilot signal is identified. The control signal $U_s$ controls a time-sequence controller 430 in a manner which is analogous to the output signals of the first detector circuit 42 in FIG. 2. The pilot evaluation circuit 411 thus takes over the function of the first detector circuit 42 in FIG. 2.

According to FIG. 6, a pilot signal $U_p$, which is reflected, for example, on the plug connector part 26 and corresponds to the second radio-frequency signal HF2, is supplied as a measurement signal to the second detector 44 (D2), via a radio-frequency coupler 413, for example a directional coupler. After inversion by the invertor 49, the signal emitted by the second detector then drives the time-sequence controller 430. The further operation takes place in the same sense as in the scheme in FIG. 3.

In other respects, the method according to the invention and the device for carrying out the method can also be used in an active bidirectional radio-frequency transmission system using two different frequency bands for the forward and rearward directions. In this case, an amplifier unit which amplifies in two directions is used instead of the amplifier 41 (FIG. 2) which transmits in one direction.

We claim:

1. Method for radio-frequency connection of active subsections of a radio-frequency transmission system for a plurality of vehicles connectable with each other in a vehicle unit, wherein each of said vehicles contains one and only one of said active subsections and said active subsections include a first subsection including a head station and at least one other subsection; said head station contains means for transmitting a first radio-frequency signal in a transmission direction, two radio-frequency cables connected electrically to the head station and plug-connector elements connected to the two radio-frequency cables and located at opposite ends of said vehicle in which said first subsection is located and each of said at least one other subsection comprises two radio-frequency cables, an amplifier having an output and an input and connected in one of said two radio-frequency cables and plug-connector elements connected to said radio-frequency cables and located at opposite ends of said vehicle in which said amplifier is located, so that said first radio-frequency signal is transmitted to said at least one other subsection when said plug-connector elements of said first subsection and said at least one other subsection are connected with each other, said method comprising the steps of:

a) providing a vehicle station (16) in the at least one other subsection and not in the first subsection, said vehicle station (16) having means for interrogating said plug-connector elements (30,31) for a presence of said first radio-frequency signal (HF1);

b) interrogating the plug-connector elements (30,31) of the at least one other subsection containing the vehicle station (16) by means of the vehicle station until the presence of the first radio-frequency signal (HF1) at at least one of the plug-connector elements has been identified;

c) interrogating said plug-connector elements of said at least one other subsection containing the vehicle station (16) by means of the vehicle station until a presence of a second radio-frequency signal (HF2) transmitted in an opposite direction to the transmission direction of the first radio-frequency signal (HF1) has been identified at at least one of the plug-connector elements so as to recognize a connected coupling state of the plug-in connector elements;

after the interrogating steps c) and b), connecting the input of the amplifier (41) with the at least one plug-connector element at which the presence of the first radio-frequency signal (HF1) is detected by means of the vehicle station (16) and the output of the amplifier (41) with the at least one plug-connector element at which the presence of the second radio-frequency signal (HF2) is detected by means of the vehicle station (16).

2. Radio-frequency transmission system comprising a plurality of active subsections, and a plurality of vehicles connectable with each other in a vehicle unit, wherein each of said vehicles contains one and only one of said active subjections, said active subsections comprise a first subsection and at least one other section; said first subsection includes a head station containing means for transmitting a first radio-frequency signal in a transmission direction, two radio-frequency cables connected electrically to the head section and plug-connector elements connected to the two radio-frequency cables and located at opposite ends of the vehicle in which the first subsection is located; the at least one other subsection comprises two radio-frequency cables, an amplifier having an output and an input and connected in one of said two radio-frequency cables and plug-connector elements connected to the radio-frequency cables located at opposite ends of the vehicle in which the amplifier is located, so that the first radio-frequency signal (HF1) is transmitted to the at least one other subsection when the plug-connector elements are connected with each other, wherein said device comprises:

a vehicle station (16) in each of said vehicles (12,13) containing said at least one other subsection and not in said vehicle containing said first subsection, said vehicle station (16) comprising means for producing a second radio-frequency signal (HF2) transmitted in a direction opposite to the transmission direction of the first radio-frequency signal (HF1);

a first detector (42) for identifying a presence of the first radio-frequency signal (HF1) at at least one of the plug-connector elements;

a second detector (44) for identifying a presence of the second radio-frequency signal (HF2) at at least one of the plug-connector elements;

switching means (40) for making connections between the plug-connector elements (30,31) and the amplifier (41) of the vehicle in which the vehicle station is located; and time-sequence controller means (43) for controlling the switching means (40) so as to connect the input of the amplifier (41) with the at least one plug-connector element at which the presence of the first radio-frequency signal (HF1) is detected by the first detector (42) and the output of the amplifier (41) with the at least one plug-connector element at which the presence of the second radio-frequency signal (HF2) is detected by the second detector (44).

3. System as defined in claim 2, wherein the head station (15) includes means for generating a pilot signal ($U_p$) and each of the amplifiers (41) is a pilot-regulated amplifier (410) including means (411) for evaluating the pilot signal ($U_p$) and each of the first detectors (42) comprises said means (411) for evaluating the pilot signal ($U_p$).

4. System as defined in claim 3, wherein said means for transmitting said second radio-frequency signal (HF2) consists of said means for transmitting the first radio-frequency signal (HF1) and means for reflecting the radio-frequency signal (HF1) on an open one of said plug-connector elements (30) to form the second radio-frequency signal (HF2).

5. System as defined in claim 3, wherein said means for transmitting said second radio-frequency signal (HF2) consists of means (51) for generating a radio-frequency measurement signal located in the at least one other subsection.

6. System as defined in claim 5, wherein each of the amplifiers (41) has a transmission frequency band and a frequency of the second radio-frequency signal (HF2) is not in said transmission frequency band.

7. System as defined in claim 2, wherein each of the amplifiers transmits signals in said transmission direction and in a direction opposite to said transmission direction.

* * * * *